US005855700A

United States Patent [19]

Guerard

[11] Patent Number: 5,855,700

[45] Date of Patent: Jan. 5, 1999

[54] BIMETALLIC CASTING SERVING AS A WEAR PIECE IN VERTICAL CRUSHING MILLS AND ITS METHOD OF MANUFACTURE

[75] Inventor: Norbert Guerard, Esneux, Belgium

[73] Assignee: Magotteaux International S.A., Vaux-Sous Chevremont, Belgium

[21] Appl. No.: 797,974

[22] Filed: Feb. 12, 1997

[51] Int. Cl.[6] ..... B22D 19/16

[52] U.S. Cl. ..... 148/522; 148/529; 148/545; 164/90; 164/111

[58] Field of Search ..... 148/522, 529, 148/545; 164/90, 111

[56] References Cited

U.S. PATENT DOCUMENTS

| | | | |
|---|---|---|---|
| 2,155,215 | 4/1939 | Beament | 148/545 |
| 3,682,227 | 8/1972 | Motz et al. | 164/95 |
| 5,238,046 | 8/1993 | Guerard | 164/111 |

FOREIGN PATENT DOCUMENTS

| | | |
|---|---|---|
| 617891 | 5/1990 | Australia . |
| 55-103265 | 8/1980 | Japan . |
| 57-68262 | 4/1982 | Japan . |
| 2078575 | 1/1982 | United Kingdom . |

OTHER PUBLICATIONS

Patent Abstracts of Japan, vol. 4, No. 150, Oct. 22, 1980 and JP,A,55 103265 (Mitsubishi Heavy Ind Ltd), Aug. 7, 1980.

Patent Abstracts of Japan, vol. 6, No. 150, Aug. 10, 1982 and JP,A,57 068262 (Mitsubishi Heavy Ind Ltd), Apr. 26, 1982.

*Primary Examiner*—George Wyszomierski
*Attorney, Agent, or Firm*—Jacobson, Price, Holman & Stern, PLLC

[57] ABSTRACT

The invention relates to a bimetallic casting serving as a wear piece in vertical mills and its method of manufacture. It includes a core (13) made of a ductile cast iron and provided with mechanical bonding elements in the form of pins (15) which are rendered integral with an outer casing (17) by casting, the outer casing being made of a non-ductile wear material having a high chromium content. Such castings are used for being mounted on the hub of a roller of a so-called vertical-axis crushing mill.

16 Claims, 9 Drawing Sheets

BIMETALLIC CASTING SERVING AS A WEAR PIECE IN VERTICAL CRUSHING MILLS AND ITS METHOD OF MANUFACTURE

SUBJECT OF THE INVENTION

The present invention relates to a bimetallic casting serving as a wear piece in mills, in particular so-called vertical crushing mills. It also applies to a method of producing such a casting intended for mills of this type.

TECHNOLOGICAL BACKGROUND OF THE INVENTION

Vertical mills consist of rollers rotating about a vertical axis on a crushing track. The crushing rollers are mounted on a central hub and are provided at their periphery with wear pieces which may take the form of segments or which may also be constituted in monobloc form.

These wear pieces are made of cast iron having a high abrasion strength, especially cast irons having a high chromium content and, consequently, are not ductile at all (their value of elongation at break is virtually equal to zero). The wear pieces are generally fastened with the aid of clamps to the hub. Due to their lack of ductility, cracks or fissures may be observed to appear under the stresses due to the various mechanical stressings, these-cracks or fissures propagating into the said pieces. Under the effect of the stresses, various other drawbacks become apparent, including, in particular, deformation of the hub. This deformation of the hub causes considerable difficulties when replacing the wear pieces and it is common to have to replace both the wear piece and the hub.

In addition, the wear piece is particularly difficult to machine after casting because of its specific properties, namely its high hardness, whereas tolerances lower than H9 are required for these machinings.

In Document GB-2 078 575 A, weldable wear pieces are described which consist of a weldable steel part provided with protrusions which, after having been placed in a mould, undergoes metallurgico-mechanical bonding obtained on casting a cast iron. These pieces are described as being able to be suitable for various uses, such as engineering castings and tools. For the cast wear part, it is proposed to use a spheroidal graphite cast iron of low wear resistance and of low weldability in which a hard metal is incorporated.

Combined metallurgico-mechanical bonding is described as making it possible to compensate for the tensions resulting from the differences in expansion coefficient between the basis alloy (graphitic cast iron) and the reinforcing material incorporated into the wear part, thus ensuring a good bond between this wear part and the weldable part and preventing the propagation of microcracks.

Document AU-B-44415/89 (Acceptance no 617891) describes a method of producing a composite wear resistant product comprising a white iron casting joined to a steel or iron backing, said method including the steps of positioning in a mould at least two steel inserts having protruding locking fingers, casting the white iron over the steel inserts and the protruding locking fingers whereby the inserts are metallurgically and mechanically locked to the white iron, and after cooling of the white iron welding the inserts together to form the backing of the product.

However, the Applicant has noticed that none of the solutions is entirely satisfactory, on the one hand because it limits the use of very hard compositions for the wear part since it is necessary to provide a metallurgico-mechanical bond or welding, and on the other hand because such a bond or welding does not sufficiently prevent cracks and microcracks from propagating but rather facilitates cracks and microcracks. This phenomenon is particularly observed in the case of large vertical mills.

AIMS OF THE INVENTION

The invention aims essentially to provide a novel design of the wear pieces of mills of the type mentioned, which ensures a series of specific advantages, in particular better resistance to cracking, absence of hub deformation under the stresses applied and, in general, greater flexibility in the system for fixing the wear pieces to the hub. It also aims to make major savings as regards to the cost of manufacture and to the lifetime of the pieces.

Other objectives and advantages of the invention will appear on reading the description and the claims.

CHARACTERISTIC ELEMENTS OF THE INVENTION

The invention relates to a bimetallic casting intended for vertical mills, including a core made of a ductile cast iron and provided with mechanical bonding elements, advantageously in the form of pins, these being fixed to an outer casing made of a non-ductile wear material having a high chromium content.

This type of casting may take the form of segments or the form of a monobloc element, for the purpose of mounting them on the hub of the rollers of vertical mills.

In the case of mounting segments, this may be carried out by clamping or bolting onto the hub; in the case of monobloc elements, assembly takes place by hooping, without the necessity of welding these elements onto the hub in either case.

In both cases, the risks of cracking are greatly reduced, even under high-stress conditions, since the area of fixing the bolts or clamps for fastening to the hub is located in that part of the core made of ductile cast iron.

Likewise, the bonding part, which is the most highly stressed, consists of pins cast with the ductile cast-iron core, thereby contributing to the mechanical strength of the assembly.

The forces generated by the crushing operation—instead of being transmitted directly from the wear piece to the hub—are in this case firstly taken up by the pins and then by the ductile cast-iron core. The consequence of this is that, on the one hand, cracks or fissures which may appear on the external periphery of the wear piece do not propagate throughout the entire mass of the wear piece. In addition, the deformations observed in the technology of hard monometallic wear pieces on a soft core are thus avoided. Finally, the surface on which the wear piece is placed, which must be machined in order to match the hub perfectly, consists in the present case of a ductile cast iron, a material which makes machining markedly easier.

In general, an overall saving is observed because of the reduction in the cost of machining, the use of a lighter casting, the savings in terms of alloy elements, and a great flexibility of use, allowing the bimetallic wear piece to be fixed equally well by clamping as by bolting, or, in the case of a monobloc element, by hooping.

The ductile cast iron used is preferably a cast iron of the SG type (GGG 40 according to the DIN 1693 standard).

Likewise, there is a greater freedom in making specific shapes, not only because they are easier to machine but also because the castings according to this particular design are less stressed mechanically and because, due to their design, it is no longer necessary, to the same extent, to take into account the large forces transmitted. This therefore makes it possible to adapt the specific shape of the wear pieces to the various types of construction of roller-type vertical mills.

The shoulder which is generally provided at the foot of the wear piece in order to attach it to the hub may be adapted to the requirements of each constructor.

The specific shape of the pins is preferably chosen so as to provide simplified fillets of rounded shape.

The castings according to the invention also make it possible to facilitate the running and feeding system for the chromium cast-iron part and to obtain better mechanical properties by virtue of the cooling effect of the ductile cast-iron part. It should be noted that the bimetallic castings produced in this way thus avoid having to rely on a solution based on a metallurgical bond. This enables the well-known drawback of a horizontal separating surface between the two cast metals to be avoided.

In addition, the absence of a metallurgical bond prevents cracks appearing in the peripheral wear piece from propagating into the core.

The use of a rounded shape for the fillets of the pins prevents the initiation of fissures and therefore contributes to a prolonged lifetime of the castings.

According to a specific embodiment of the invention, the pins may take the form of a dovetail.

A first embodiment of a method for manufacturing such a casting which is particularly advantageous as a result of the choice of the materials involved comprises firstly to cast the core with the pins in a first mould and subsequently, after having applied on the cast part a refractory coating intended to prevent a metallurgical bond, to cast the outer casing in a second mould.

Alternatively a second embodiment of a manufacturing method which is identically advantageous as a result of the choice of the materials involved comprises firstly to cast the outer casing in a first mould and subsequently, after having applied on the cast part a refractory coating intended to prevent a metallurgical bond, to cast the core with the pins in a second mould.

Finally, in both embodiments, a complete heat treatment is carried out, taking into account the nature of the elements constituting the casting and possibly of the machining envisaged, in particular of the mill and of the materials to be crushed, using the criteria well known to those specializing in these materials.

The invention will be described in more detail with reference to a preferred embodiment thereof, with regard to the appended drawings.

Further details and characteristic elements of the invention will appear on reading the following description.

Figure 1:
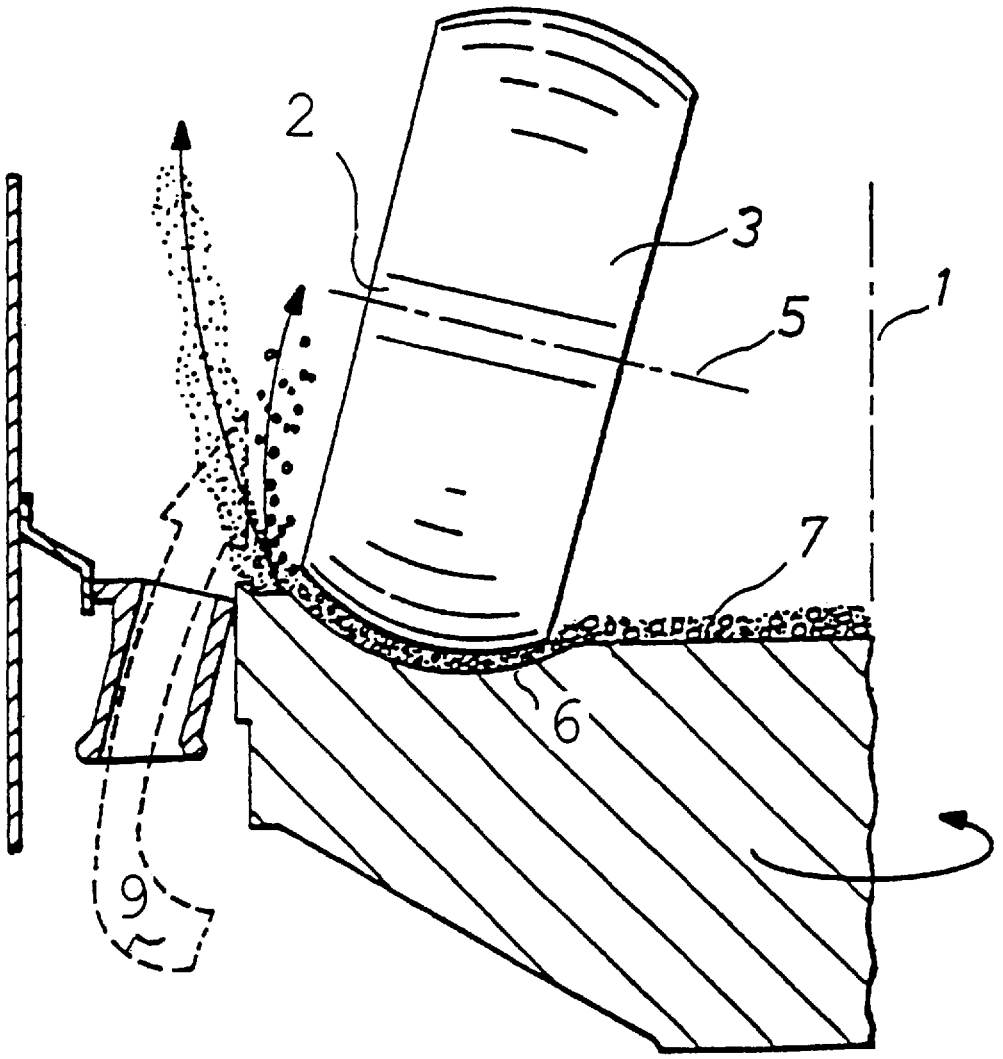
FIG. 1 represents diagrammatically the arrangement of a crushing roller in a vertical-axis crushing mill.
Figure 2:
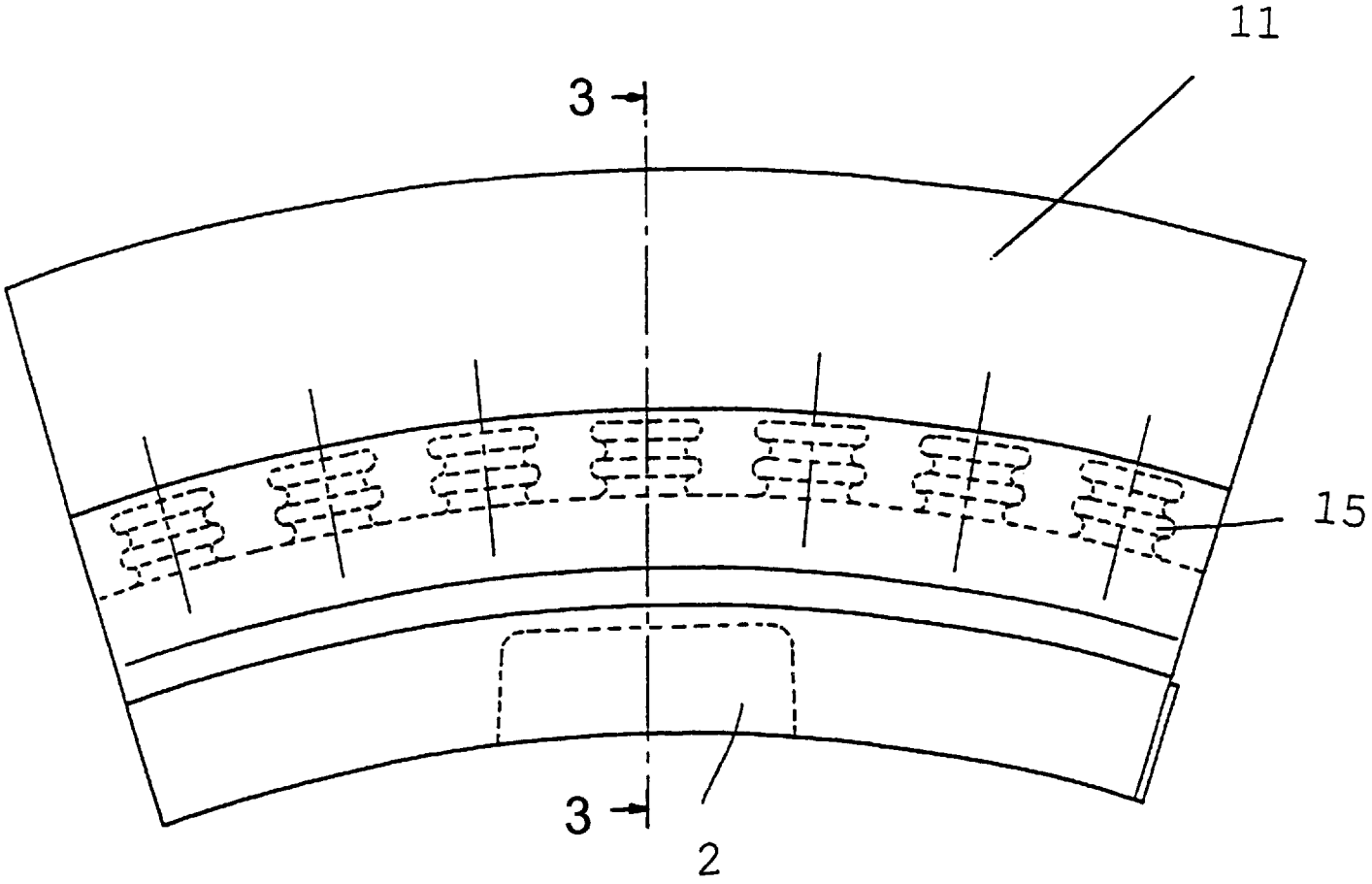
FIG. 2 represents, by way of illustration of a particular embodiment of the invention, a segment of roller according to the invention.
Figure 3:
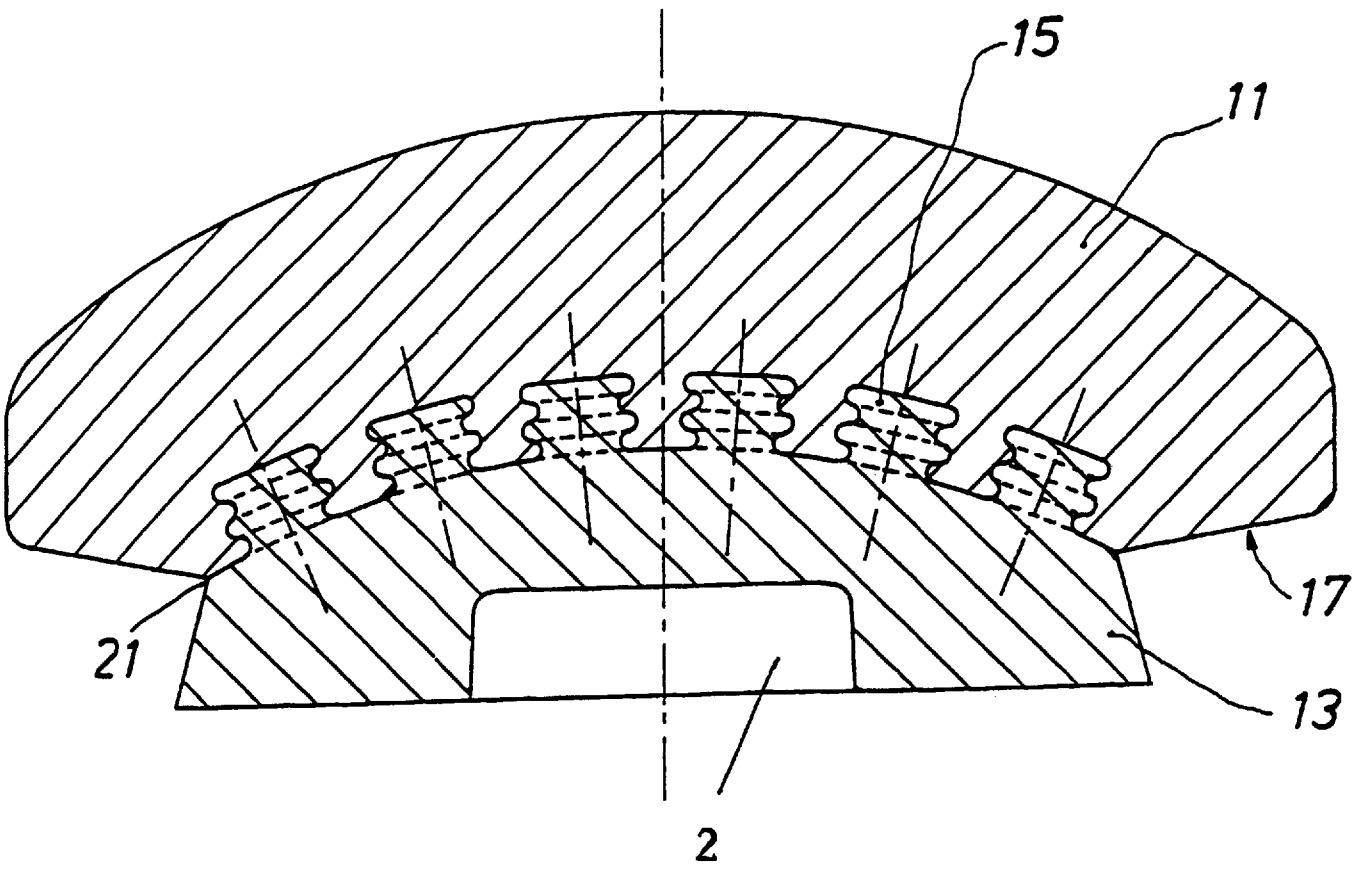
FIG. 3 is a cross-section AB in the embodiment of FIG. 2.

The central axis of rotation of the so-called vertical-axis crushing mill has been indicated in FIG. 1 by the reference 1. In a manner known per se, a roller 3 is driven with respect to the axis 1 by rotating, by means of a hub 2 shown diagrammatically, about an axis 5 which may be slightly inclined (as shown) or horizontal, for the purpose of crushing the material fed between the roller and the crushing track 6. The reference 7 represents the material to be crushed, fed centrally into the mill. After crushing, the fines are extracted from the mill and the coarsest particles are sent back towards the crushing track 6 by an airflow, shown diagrammatically by the arrow 9.

As will be noted, the roller 3 is rounded on its peripheral part and the track has a corresponding shape.

The wear piece proper, bearing the general reference 11, is formed by a core 13 including pins 15 which are obtained by foundry and onto which an outer casing 17 is cast.

The essential characteristic of the invention is the fact that the core 13 and bonding elements in the form of pins 15, which are cast, are formed from a ductile material, namely SG cast iron, whereas the outer casing 17 is made from non-ductile alloys, in particular chromium cast irons of hardness >64 Rc customarily used as wear pieces.

It should be noted that the shoulder of the outer casing 17 with respect to the core 13 may be easily adapted to the various requirements of the manufacturers, all the more so since the peripheral junction line 21 between the outer casing 17 and the core 13 lies advantageously within the internal angle of the shoulder, thereby preventing this line from being exposed to the direct action of the material to be crushed.

A particularly simple constructional design is produced in this way.

Virtually half the mass that formerly made up a monometallic wear piece fixed to a hub is, according to the invention, constituted by the ductile core, thereby leading to a major saving in terms of expensive alloy elements.

It should be noted that although an embodiment of the wear piece has been described in the form of segments, it is also possible to construct a monobloc hoop according to the inventive design of the invention.

A method employed for producing the wear piece according to the invention consists in the first place in casting in a first mould the core 13 with the pins 15, after having applied a refractory coating on the cast part, the casting is placed in a second mould and the outer casing 17 is cast. The whole assembly then under-goes a complete heat treatment.

Alternatively a method according to the invention consists in the first place in casting in a first mould the outer casing 17, after having applied a refractory coating on the cast part, the casting is placed in a second mould and the core 13 with the pins 15 is cast. The whole assembly then also undergoes a tempering heat treatment.

In order to illustrate the invention, an embodiment example of a casting according to the invention and the results of laboratory tests obtained will be described herein below.

EXAMPLE 1

Mechanical bond bimetal test

Figure 4:
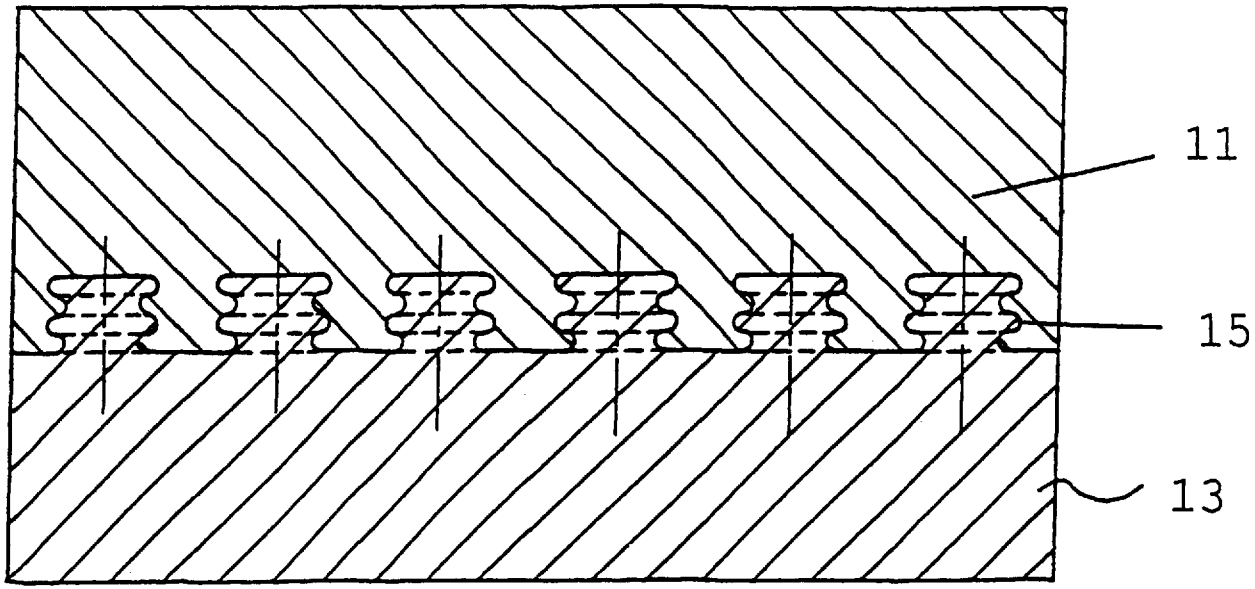
FIGS. 4 and 5 are again an example of a casting produced according to the invention, FIG. 4 being a section along CD of FIG. 5.
Figure 5:
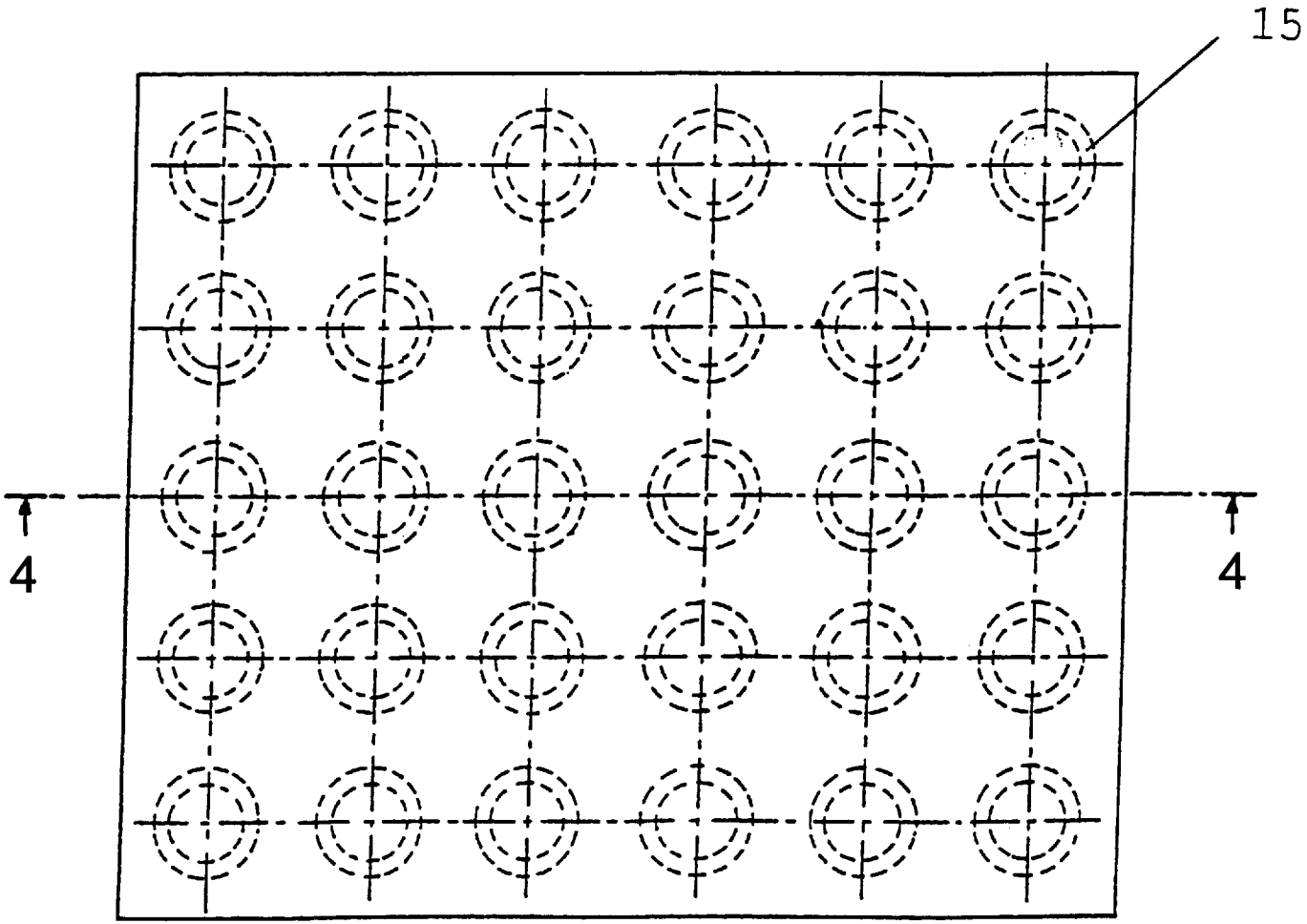
Figure 6A:
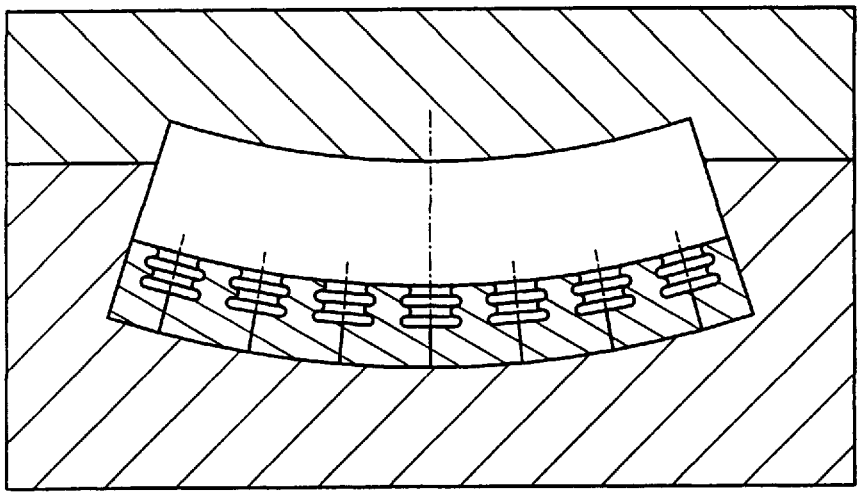
FIGS. 6A and 6B illustrate for two specific shapes respectively, how a first base is obtained by foundry from a SG cast iron in a first mould.
Figure 6B:
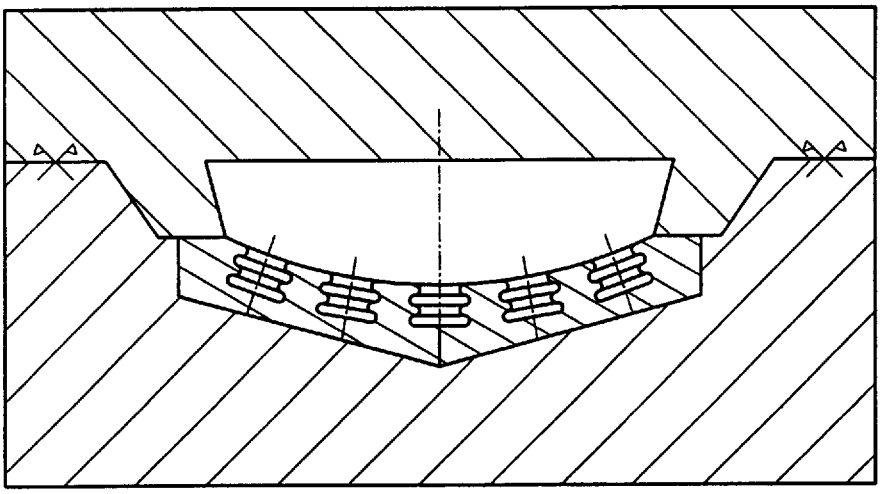
Figure 7A:
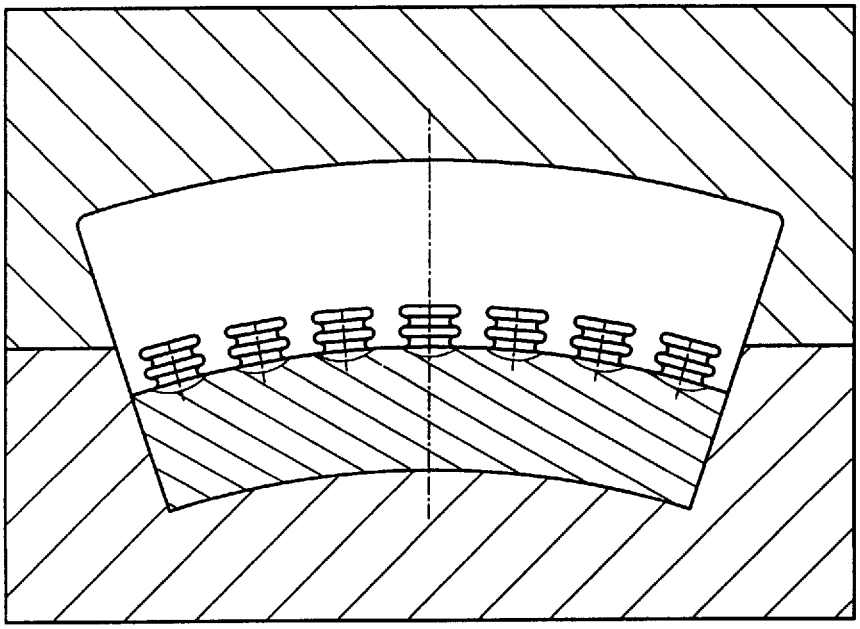
FIGS. 7A and 7B corresponding to FIGS. 6A and 6B respectively illustrate how this base GS is placed in a second mould for casting chromium cast iron intended to form the top.
Figure 7B:
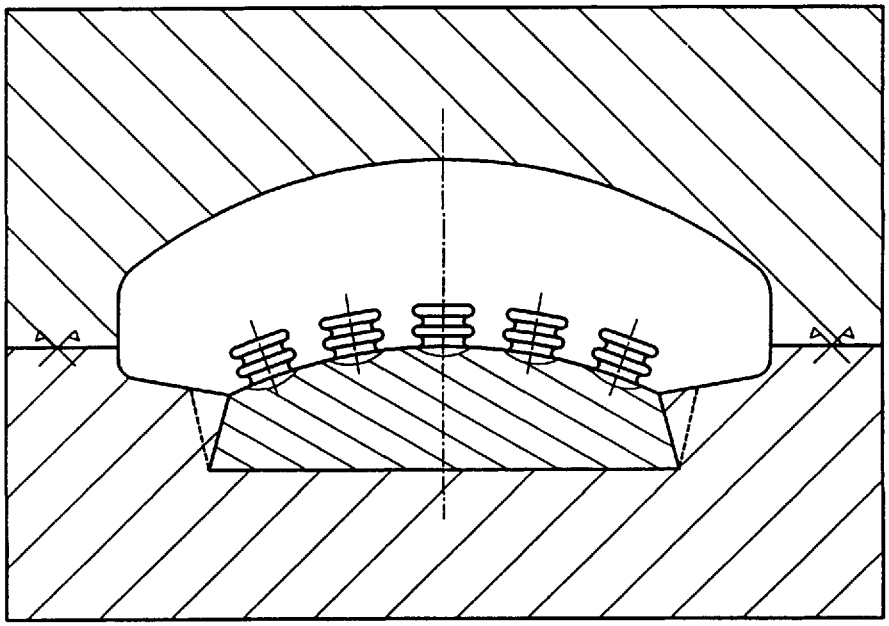
Figure 8A:
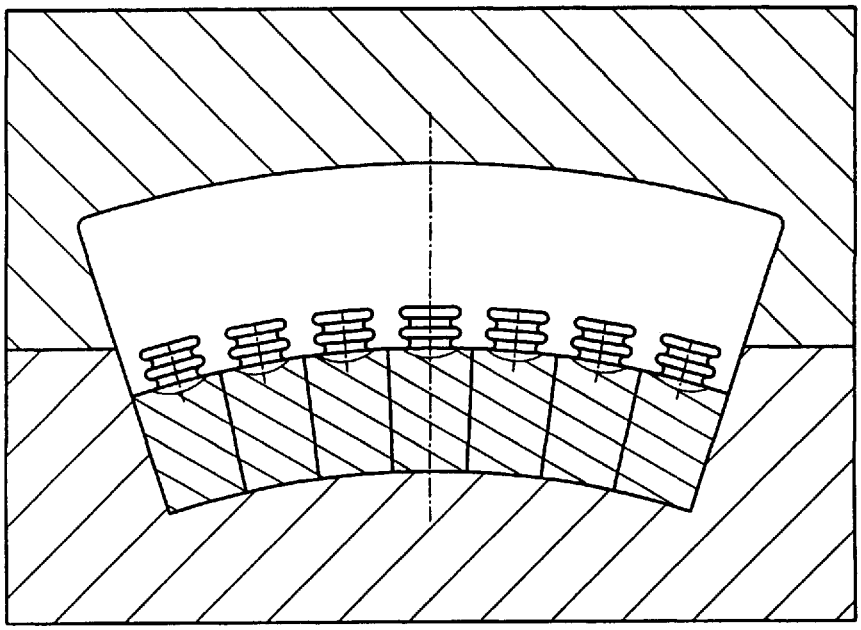
FIGS. 8A and 8B illustrate as an alternative process how the top made of chromium cast iron is obtained for two specific shapes (8A and 8B respectively) in a first mould and FIGS. 9A and 9B corresponding to FIGS. 8A and 8B illustrate how the top made of chromium cast iron is placed in a second mould for casting the base made of SG cast iron.
Figure 8B:
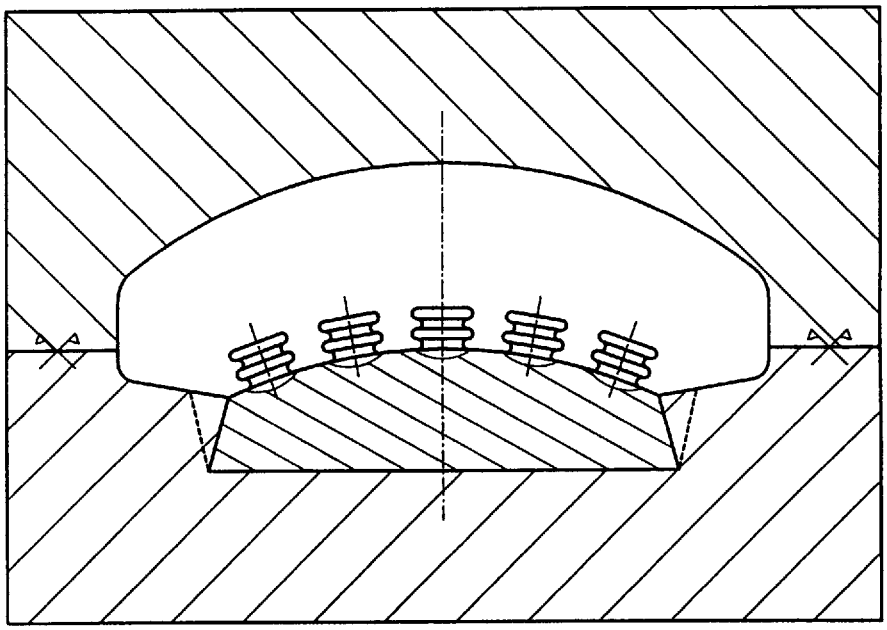
Figure 9A:
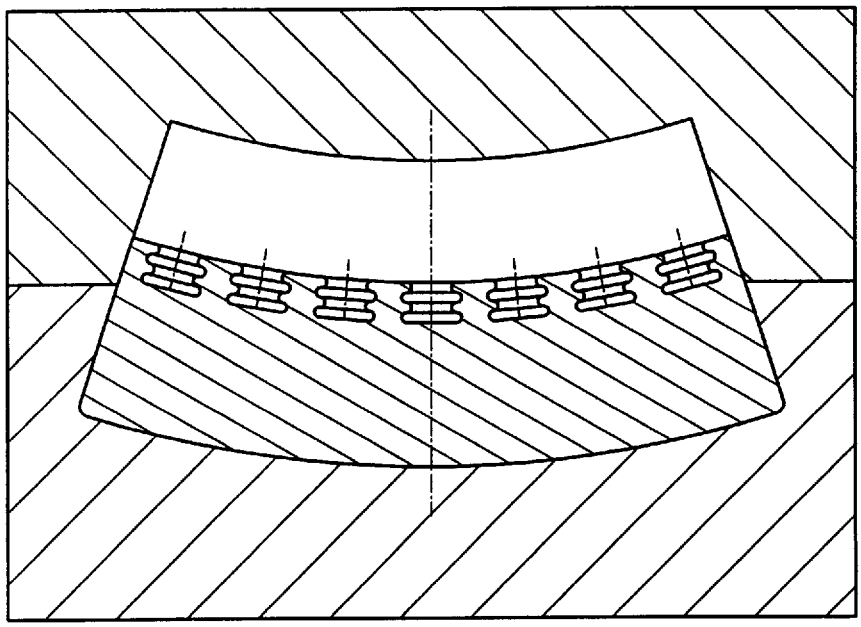
Figure 9B:
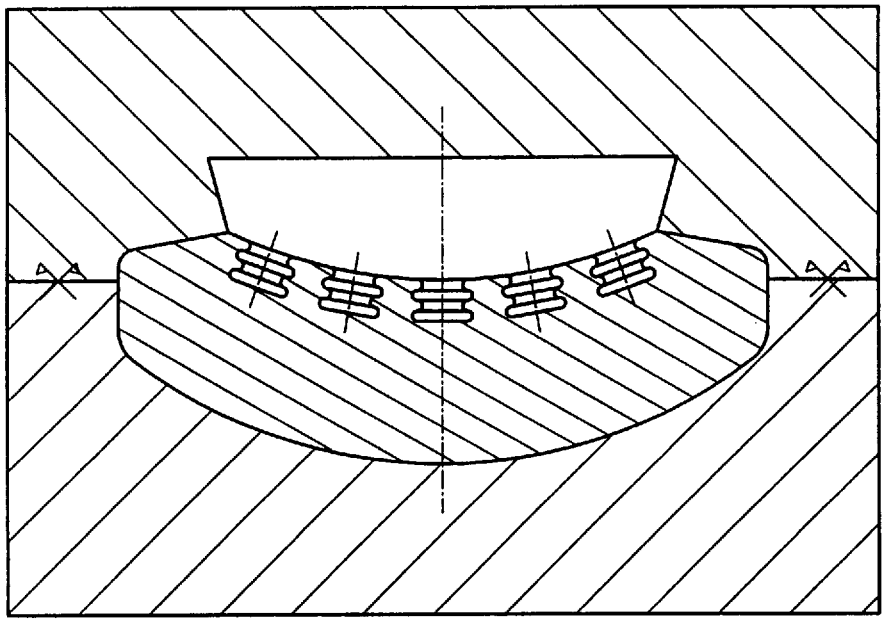

The casting of FIGS. 4 and 5 is a bimetallic block of 230×275×150 mm formed by a part corresponding to the core 13 and to the pins 15 made of SG cast iron (GGG40) and by part of the outer casing 11 made of chromium cast iron of hardness greater than or equal to 64 Rc.

After deburring, a refractory coating (not shown) is applied to this part in order to prevent remelting of the pins and the risk of a metallurgical bond with the chromium cast iron.

After having placed this block in a second mould, the chromium cast iron was cast onto it.

The bimetal block was then deburred and tempered.

Fatigue tests were carried out.

The tests were performed in a SCHENK machine having a maximum capacity of 2500 kN.

The signal applied is sinusoidal.

The assembly was subjected to a 100 kN–2000 kN oscillating compressive load generating maximum contact pressures 3 times greater than those subjected by a roller in service.

The assembly tested underwent no apparent degradation during 465,000 cycles.

I claim:

1. Method for manufacturing a bimetallic casting including a core made of ductile cast iron and including mechanical bonding elements, and an outer casing made of non-ductile wear material, wherein only said mechanical bonding elements are bonded to the outer casing by a mechanical bonding only, said method comprising casting said core with mechanical bonding elements in a first mould, applying a refractory coating to the core, placing the core in a second mould and casting the outer casing onto said core by rendering only said mechanical bonding elements of the core integral with the outer casing, and finally performing a tempering heat treatment.

2. Method according to claim 1, further including the formation of a peripheral junction line between said outer casing and said core and wherein the casting step of said outer casing includes the casting of shoulders with internal angles such that said junction line is located within said internal angles of the shoulders of said outer casing.

3. Method according to claim 1, wherein said casting step of the core comprises the casting of said bonding elements with ductile cast iron in the form of pins having fillets of rounded shape.

4. Method for manufacturing a wear piece in mills having a roller and a hub, comprising the steps of manufacturing a bimetallic casting according to claim 1, and further comprising the step of mounting said casting onto the hub of said roller.

5. Method according to claim 4, wherein said mounting step is achieved by clamping or bolting the core onto the hub.

6. Method according to claim 4, wherein said mounting step is achieved by hooping the core onto the hub.

7. Method according to claim 1, wherein the ductile cast iron is a spheroidal graphite cast iron.

8. Method according to claim 1, wherein the non-ductile wear material is a chromium cast iron of hardness greater than or equal to 64 Rc.

9. Method for manufacturing a bimetallic casting including a core made of ductile cast iron and including mechanical bonding elements, and an outer casing made of non-ductile wear material, wherein only said mechanical bonding elements are bond to the outer casing by a mechanical bonding only, said method comprising the steps of casting the outer casing in a first mould, applying a refractory coating to the outer casing, placing the outer casing in a second mould and casting said core with mechanical bonding elements onto said outer casing, by rendering only said mechanical bonding elements of the core integral with the outer casing, and finally performing a tempering heat treatment.

10. Method according to claim 9, further including the formation of a peripheral junction line between said outer casing and said core and wherein the casting step of said outer casing includes the casting of shoulders with internal angles such that said junction line is located within said internal angles of the shoulders of said outer casing.

11. Method according to claim 9, wherein said casting step of the core comprises the casting of said bonding elements with ductile cast iron in the form of pins having fillets of rounded shape.

12. Method for manufacturing a wear piece in mills having a roller and a hub, comprising the steps of manufacturing a bimetallic casting according to claim 9, and further comprising the step of mounting said casting onto the hub of said roller.

13. Method according to claim 12, wherein said mounting step is achieved by clamping or bolting the core onto the hub.

14. Method according to claim 12, wherein said mounting step is achieved by hooping the core onto the hub.

15. Method according to claim 9, wherein the ductile cast iron is a spheroidal graphite cast iron.

16. Method according to claim 9, wherein the non-ductile wear material is a chromium cast iron of hardness greater than or equal to 64 Rc.

* * * * *